US009890552B2

(12) United States Patent
Schneider et al.

(10) Patent No.: US 9,890,552 B2
(45) Date of Patent: Feb. 13, 2018

(54) ADJUSTABLE OPENING FOR A HUNTING BLIND

(71) Applicant: PD2F, Inc., Missoula, MT (US)

(72) Inventors: Jason D. Schneider, Missoula, MT (US); Jerrod R. Lile, Plains, MT (US)

(73) Assignee: PD2F, Inc., Missoula, MT (US)

( * ) Notice: Subject to any disclaimer, the term of this patent is extended or adjusted under 35 U.S.C. 154(b) by 0 days.

(21) Appl. No.: 15/090,382

(22) Filed: Apr. 4, 2016

(65) Prior Publication Data

US 2016/0289995 A1 Oct. 6, 2016

Related U.S. Application Data

(60) Provisional application No. 62/141,926, filed on Apr. 2, 2015.

(51) Int. Cl.

| | |
|---|---|
| ***E04H 15/32*** | (2006.01) |
| ***E04H 15/00*** | (2006.01) |
| ***E04H 15/34*** | (2006.01) |
| ***E04H 15/14*** | (2006.01) |
| ***E04H 15/58*** | (2006.01) |

(52) U.S. Cl.

CPC ..... *E04H 15/001* (2013.01); *E04H 15/14* (2013.01); *E04H 15/32* (2013.01); *E04H 15/34* (2013.01); *E04H 15/58* (2013.01)

(58) Field of Classification Search

CPC ..... E04H 15/001; E04H 15/14; E04H 15/64; E04H 15/32; E04H 15/58

USPC ..... 135/93, 97, 123, 115, 119, 120.1–120.2, 135/120.4, 147, 901; 296/77.1, 79; 160/180–181, 201

See application file for complete search history.

(56) References Cited

U.S. PATENT DOCUMENTS

| | | | | |
|---|---|---|---|---|
| 851,141 | A * | 4/1907 | Stempel | E04H 15/16 135/119 |
| 2,230,454 | A * | 2/1941 | Friesner | E04H 15/32 135/117 |
| 2,719,384 | A * | 10/1955 | Eames | A63H 33/008 135/117 |
| 6,718,565 | B1 * | 4/2004 | Cruz | E04H 1/1216 135/117 |
| 6,892,744 | B2 * | 5/2005 | Feldpausch | E04H 15/001 135/114 |
| 7,182,091 | B2 * | 2/2007 | Maddox | A01M 31/025 135/90 |
| 7,475,699 | B2 | 1/2009 | Johnson et al. | |
| 7,717,124 | B1 | 5/2010 | Johnson et al. | |

(Continued)

*Primary Examiner* — Winnie Yip

(74) *Attorney, Agent, or Firm* — Sheridan Ross P.C.

(57) ABSTRACT

A hunting blind with an adjustable opening is provided to increase the flexibility of the hunting blind when the hunting blind is used in various activities. One or more covers at least partially cover the adjustable opening to produce a modified opening. Some embodiments of the invention may comprise fasteners, cords, and other components to arrange the one or more covers in different configurations. Various embodiments of the invention may also have a pass-through feature in an exterior wall of the hunting blind that provide access to the external environment. This may be advantageous for objects such as tripods where one of the tripod's legs may extend through the pass-through feature so that the tripod may be positioned closer to the exterior wall, which saves space in the hunting blind.

8 Claims, 11 Drawing Sheets

(56) References Cited

U.S. PATENT DOCUMENTS

| | | | | |
|---|---|---|---|---|
| 7,740,300 | B2 * | 6/2010 | Marsh | B60J 5/0487 296/77.1 |
| 7,984,725 | B1 | 7/2011 | Johnson et al. | |
| 8,056,572 | B2 * | 11/2011 | Livacich | E04H 15/001 135/115 |
| 8,181,661 | B2 * | 5/2012 | Livacich | E04H 15/001 135/115 |
| 8,397,738 | B2 * | 3/2013 | Livacich | E04H 15/001 135/114 |
| 8,663,553 | B2 * | 3/2014 | Elrod | A61L 9/015 422/120 |
| 8,776,814 | B1 | 7/2014 | Beam et al. | |
| 8,826,927 | B1 | 9/2014 | Beam et al. | |
| 8,915,258 | B1 | 12/2014 | Beam et al. | |
| 2005/0199356 | A1 * | 9/2005 | Nien | E06B 9/262 160/348 |
| 2010/0200038 | A1 * | 8/2010 | Roman | E04H 15/001 135/144 |

* cited by examiner

ADJUSTABLE OPENING FOR A HUNTING BLIND

CROSS-REFERENCE TO RELATED APPLICATIONS

This application claims priority under 35 U.S.C. § 119(e) to U.S. Provisional Patent Application Ser. No. 62/141,926 filed Apr. 2, 2015, which is incorporated herein in its entirety by reference.

FIELD OF THE INVENTION

The invention generally relates to hunting blinds for use by hunters, photographers, or outdoorsmen. More specifically, the invention relates to hunting blinds with adjustable openings and pass-through features.

BACKGROUND OF THE INVENTION

Outdoorsmen such as hunters, nature observers, bird watchers, photographers, etc. usually prefer to remain hidden from the wildlife that they are hunting or studying. Hunting blinds are devices that cover and conceal a hunter to reduce the likelihood of detection. Early examples of hunting blinds include the cocking-cloth, a canvas and stick device that allowed hunters to approach pheasants. While early hunting blinds were relatively simple in design, modern hunting blinds may be complex and approach the size of a small house. Modern hunting blinds typically comprise one or more openings through which a user may have access to the outside environment.

Modern hunting blinds, including permanent structures and portable blinds, have limited functionality with respect to openings. Prior art hunting blinds typically have openings on one or more sides of the hunting blind; however, the size and location of these openings are fixed or relatively fixed. Examples of these hunting blind may be found in U.S. Pat. Nos. 8,776,814, 8,826,927, and 8,915,258, which are hereby incorporated by reference in their entirety. However, these fixed openings may not be effective for different sized users or different terrain. For example, a young hunter may require an opening in a different position that an older, taller hunter. Similarly, a hunting blind set up on a hillside may have openings oriented into the ground or into the sky. Moreover, there is a large variation in user size and terrain, and thus fixed openings hinder the ability of a user to function within a hunting blind.

In addition, different hunting endeavors may require different fields of view. Some hunting endeavors may require a larger field of view, for example, when bird hunting. Other hunting endeavors may necessitate a narrow field of view to avoid detection. Yet other endeavors such as animal watching and photography may require other fields of view. To accommodate these different endeavors, a user would have to buy several different types of hunting blinds specifically tailored for the particular use. This dramatically increases costs. Therefore, there is a need for an improved hunting blind that can accommodate various activities terrain, and individual stature that require different opening characteristics from a hunting blind.

SUMMARY OF THE INVENTION

It is thus an aspect of embodiments of the invention to provide a hunting blind with a highly adjustable opening. One or more covers may be used to manipulate an opening in the exterior wall of the hunting blind to produce a modified opening. Further, the covers may also comprise a relatively elastic material, thus allowing the covers to suit different requirements for different activities, terrain, and user stature.

The covers may employ fasteners and straps to manipulate the size and the shape of the modified opening. A cord may be positioned on the edges of top and bottom covers, and a plurality of first fasteners may be positioned long the cord. Second fasteners may be positioned in a variety of locations on the hunting blind. For example, second fasteners may be positioned on an inner surface of the hunting blind and/or vertical straps positioned proximate to a hub or a corner of the hunting blind. The fasteners selectively interconnect to each other such that the cord, and thus the edge of the covers, is manipulated and the cover takes on various sizes and shapes.

It is another aspect of embodiments of the invention to provide a hunting blind with a pass-through feature in the exterior wall that allows selective access to the external environment. In some embodiments, the pass-through feature allows a tripod to be positioned closer to the exterior wall and save space within the hunting blind. One of tripod's legs may extend through the pass-through feature. A sleeve may be positioned over an opening of the pass through feature wherein the sleeve receives the tripod leg and unfurls as the tripod leg extends through the pass-through feature. This sleeve prevents the typically metallic legs of a tripod from disrupting the camouflaging function of the hunting blind.

One particular embodiment of the present invention is a portable blind with an adjustable opening, comprising an exterior wall defining an interior volume; an opening in the exterior wall, the opening having a first area; a top cover partially closing the opening, the top cover having a bottom edge, wherein the bottom edge at least partially defines a passage extending along the top cover; a bottom cover partially closing the opening, the bottom cover having a top edge, wherein the top edge at least partially defines a passage extending along the top cover; a vertically oriented strap positioned at an edge of the exterior wall, the strap having a first end and a second end, the first end selectively interconnected to an upper portion of the exterior wall and the second end selectively interconnected to a lower portion of the exterior wall such that the strap extends across the opening, the strap having a plurality of first fasteners; a first cord disposed in the passage of the top cover, wherein at least one second fastener on the first cord is selectively interconnected to the plurality of first fasteners on the strap to control a position of the bottom edge of the top cover over the opening; and a second cord disposed in the passage of the bottom cover, wherein at least one second fastener on the second cord is selectively interconnected to the plurality of first fasteners on the strap to control a position of the top edge of the bottom cover over the opening, wherein the top cover and the bottom cover at least partially define a modified opening having a second area, wherein the first area is larger than the second area.

Embodiments of the system may comprise additional features. For example, in some embodiments, the top cover has a first shape in a relaxed state, and the top cover has a second shape in a tensioned state when the first cord is selectively interconnected to the strap, wherein the first shape is distinct from the second shape.

Another particular embodiment of the present invention is a portable blind with an adjustable, variable access opening, comprising an exterior wall defining an interior volume; an opening in the exterior wall, the opening having a first area; a top cover partially closing the opening, the top cover having a bottom edge, wherein the bottom edge at least partially defines a passage extending along the top cover; a bottom cover partially closing the opening, the bottom cover having a top edge, wherein the top edge at least partially defines a passage extending along the bottom cover; a first cord disposed in the passage of the top cover, the first cord selectively interconnected to an inner surface of the exterior wall to control a position of the bottom edge of the top cover over the opening; and a second cord disposed in the passage of the bottom cover, the second cord selectively interconnected to the inner surface of the exterior wall to control a position of the top edge of the bottom cover over the opening, wherein the top cover and the bottom cover at least partially define a modified opening having a second area, wherein the first area is larger than the second area.

Embodiments of the hunting blind may have additional features. For example, some embodiments of the invention further comprise a vertically oriented strap having a first end and a second end, the first end selectively interconnected to an upper portion of the exterior wall, and the second end selectively interconnected to a lower portion of the exterior wall, wherein the first and second cords are selectively interconnected to the strap. In various embodiments, the first cord further comprises a first fastener and the strap further comprises a second fastener, and wherein the first fastener is selectively interconnected to the second fastener.

In some embodiments, the hunting blind further comprises a second strap positioned adjacent a hub of the hunting blind, the hub interconnected to a frame that supports the exterior wall, wherein the second strap has a first end and a second end, the first end selectively interconnected to the upper portion of the exterior wall, and the second end selectively interconnected to the lower portion of the exterior wall, wherein the first and second cords are selectively interconnected to the second strap.

In various embodiments, the strap is positioned at an edge of the exterior wall, and the strap extends across the opening. In some embodiments, the hunting blind further comprises a first fastener disposed at one end of the first cord and another first fastener disposed at the other end of the first cord; and a plurality of second fasteners disposed on the inner surface of the exterior wall, wherein the first fasteners of the first cord are selectively interconnected to the plurality of second fasteners.

In various embodiments, the top cover has a first shape in a relaxed state, and the top cover has a second shape in a tensioned state, wherein the first shape is distinct from the second shape. In some embodiments, the hunting blind further comprises a pass-through feature disposed on the exterior wall, the pass-through feature comprising a pass-through opening, a flap positioned proximate to the pass-through opening on an inner surface of the exterior wall, and a rigidity element disposed across the pass-through opening, wherein the flap selectively covers at least a portion of the pass-through opening. In various embodiments, a first fastener of the first cord is selectively interconnected to a second fastener of the hunting blind, wherein the first fastener has a central area, and the second fastener is a ring, wherein the first fastener hooks onto the second fastener and the ring is positioned in the central area to provide the selective interconnection.

Yet another particular embodiment of the present invention is a method of adjusting a variable shaped opening in a portable blind, comprising (i) providing an exterior wall that defines an interior volume, wherein the exterior wall has an opening with a first area; (ii) partially closing the opening with a top cover having a bottom edge, wherein the bottom edge at least partially defines a passage extending along the top cover; (iii) partially closing the opening with a bottom cover having a top edge, wherein the top edge at least partially defines a passage extending along the bottom cover; (iv) disposing a first cord in the passage of the top cover, the first cord having two ends and an initial length in a relaxed state; (v) disposing a second cord in the passage of the bottom cover, the second cord having two ends and an initial length in a relaxed state; (vi) extending the first cord to a stretched length in a tensioned state and selectively interconnecting the both ends of first cord to the exterior wall, and wherein the stretched length is longer than the initial length; and (vii) extending the second cord to a stretched length in a tensioned state and selectively interconnecting the both ends of the second cord to the exterior wall, the stretched length is longer than the initial length, and the top cover and the bottom cover at least partially define a modified opening having a second area, wherein the first area is larger than the second area.

Embodiments of the hunting blind may have additional features. For example, some embodiments of the method may further comprise (viii) providing a strap having a first end and a second end, the first end selectively interconnected to an upper end of the exterior wall, and the second end selectively interconnected to a lower end of the exterior wall, wherein the first and second cords are selectively interconnected to the strap. In various embodiments, the method further comprises (ix) providing a first fastener on the first cord and a second fastener on the strap, wherein the first fastener is selectively interconnected to the second fastener.

In some embodiments, the method further comprises (x) positioning a second strap adjacent to a hub of the hunting blind, the second strap having a first end and a second end, the first end selectively interconnected to the upper end of the exterior wall, and the second end selectively interconnected to the lower end of the exterior wall, wherein the first and second cords are selectively interconnected to the second strap; and (xi) positioning a third strap positioned adjacent to a second hub of the hunting blind, the third strap having a first end and a second end, the first end selectively interconnected to the upper end of the exterior wall, and the second end selectively interconnected to the lower end of the exterior wall, wherein the first and second cords are selectively interconnected to the third strap.

In various embodiments, the method further comprises (xii) positioning the strap at an edge of the exterior wall, wherein the strap extends across the opening. In some embodiments, the method further comprises (xiii) disposing a first fastener at one end of the first cord and another first fastener at the other end of the first cord; and (xiv) disposing a plurality of second fasteners on an inner surface of the exterior wall, wherein the first fasteners of the first cord are selectively interconnected to the plurality of second fasteners. In various embodiments, the top cover has a first shape in a relaxed state, and the top cover has a second shape in a tensioned state, wherein the first shape is distinct from the second shape.

In some embodiments, the method further comprises (xv) disposing a pass-through feature on the exterior wall, the pass-through feature comprising a pass-through opening, a flap positioned proximate to the pass-through opening on an inner surface of the exterior wall, and a rigidity element disposed across the pass-through opening, wherein the flap selectively covers at least a portion of the pass-through opening. In various embodiments, the method further comprises (xvi) selectively interconnecting a first fastener of the first cord to a second fastener of the hunting blind, wherein the first fastener has a central area, and the second fastener is a ring, wherein the first fastener hooks onto the second fastener and the ring is positioned in the central area to provide the selective interconnection.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1A:
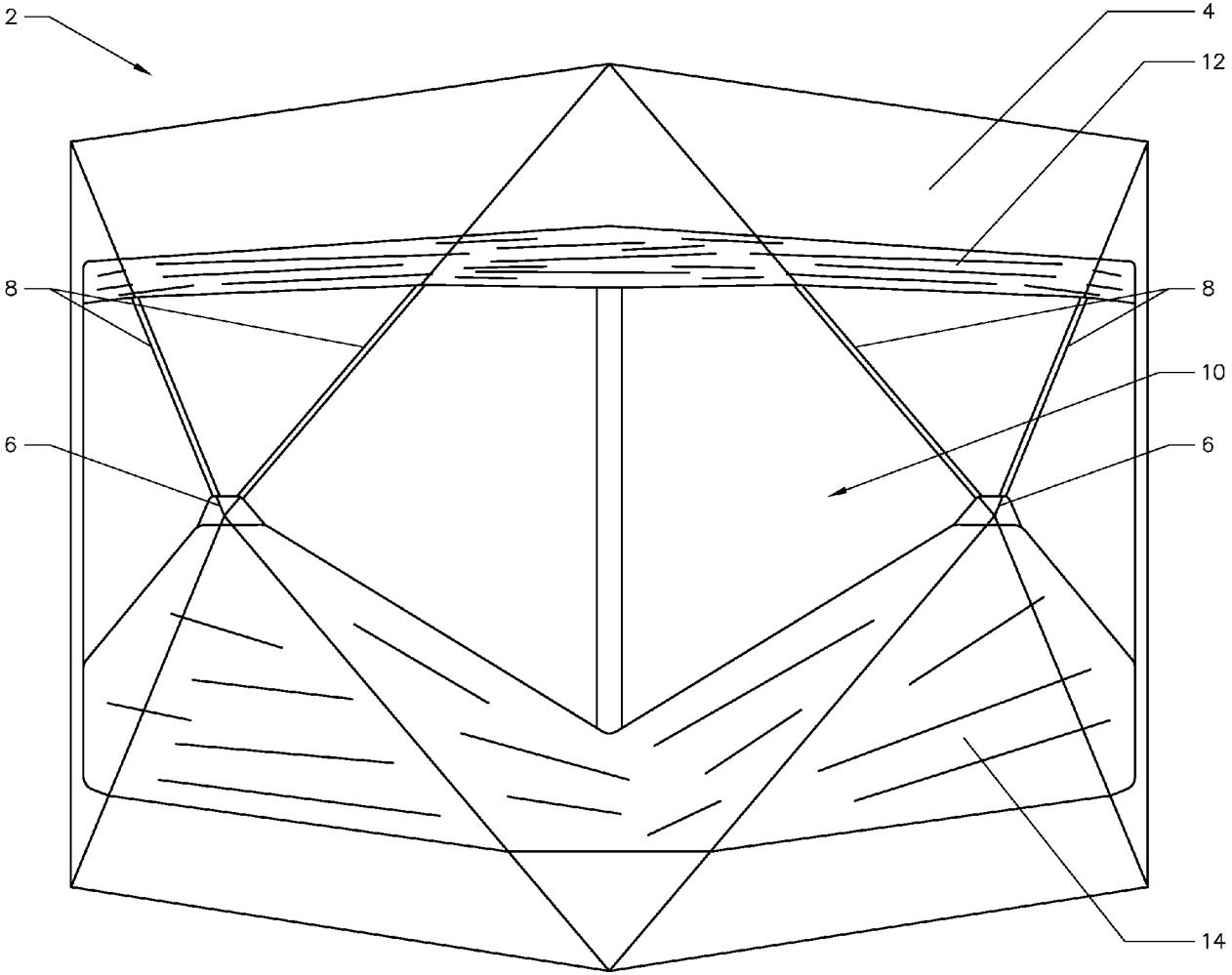
FIG. 1A is a front elevation view of a hunting blind with an opening in accordance with embodiments of the invention.

To assist in the understanding of the embodiments of the invention the following list of components and associated numbering found in the drawings is provided herein:

| Component No. | Component |
|---|---|
| 2 | Hunting Blind |
| 4 | Exterior Wall |
| 6 | Hub |
| 8 | Pole |
| 10 | Opening |
| 12 | Top Cover |
| 14 | Bottom Cover |
| 16 | Bottom Edge of the Top Cover |
| 18 | Top Edge of the Bottom Cover |
| 20 | Cord |
| 22 | First Fastener |
| 24 | Strap |
| 26 | Second Fastener |
| 28 | Third Fastener |
| 30 | Pass-Through Feature |
| 32 | Pass-Through Opening |
| 34 | Pass-Through Strap |
| 36 | Sealing Flap |
| 40 | Tripod |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the invention are described herein and as depicted in the drawings. It is expressly understood that although the figures depict hunting blinds, covers, and fasteners, the invention is not limited to these embodiments. Further, terms such as "fasteners," "first fasteners," and "second fasteners" as well as "hunting blind" and "portable blind" may be interchangeable in some instances.

Now referring to FIG. 1A, a front view of a hunting blind 2 with an adjustable opening 10 is provided. The hunting blind 2 has an exterior wall 4 that defines an interior volume of the hunting blind 2 where a user may set up gear for hunting, photography, etc. The exterior wall 4 of a portable hunting blind 2, like the blind in FIG. 1A, is typically made from a material that is collapsible. Thus, the hunting blind 2 comprises a plurality of hubs 6 and poles 8 that serve as a frame. The ends of the poles 8 are typically interconnected to the corners of the exterior wall 4. In a collapsed state, the poles 8 are generally parallel to one another, and the exterior wall's 4 material is loose. In an opened state, the poles 8 spread out from one another until the poles 8 and hub 6 lie in a common plane. The hub 6 continues to extend outward and "pops" into place such that the exterior wall's 4 material is taught and extends outward and away from the center of the hunting blind 2 to provide the user with additional room and to provide the hunting blind 2 with additional structural integrity.

An opening 10 is disposed in two walls of the hunting blind 2 in FIG. 1A. The opening 10 is a portion of the hunting blind 2 that does not comprise an exterior wall 4. A top cover 12 is disposed on the top side of the opening 10, and a bottom cover 14 is disposed on the bottom side of the opening 10. Together, the top and bottom covers 12, 14 can manipulate the shape of the opening 10 into a modified opening wherein the modified opening has a smaller area than the entirety of the opening 10. The modified opening is customizable to suit any activity including different types of hunting, animal watching, and photography.

One or more of the covers 12, 14 may be comprised of a material that permits the covers 12, 14 to change between a first shape and a second shape. Thus, in some embodiments, a cover may comprise between about 1% and 50% elastane, neoprene, or other stretchable material. In various embodiments, a cover may comprise between about 5% and 20% elastane, neoprene, or other stretchable material. Further, these materials may be incorporated into a cover such that the cover stretches only in discrete directions, for example, one or two directions.

Figure 1B:
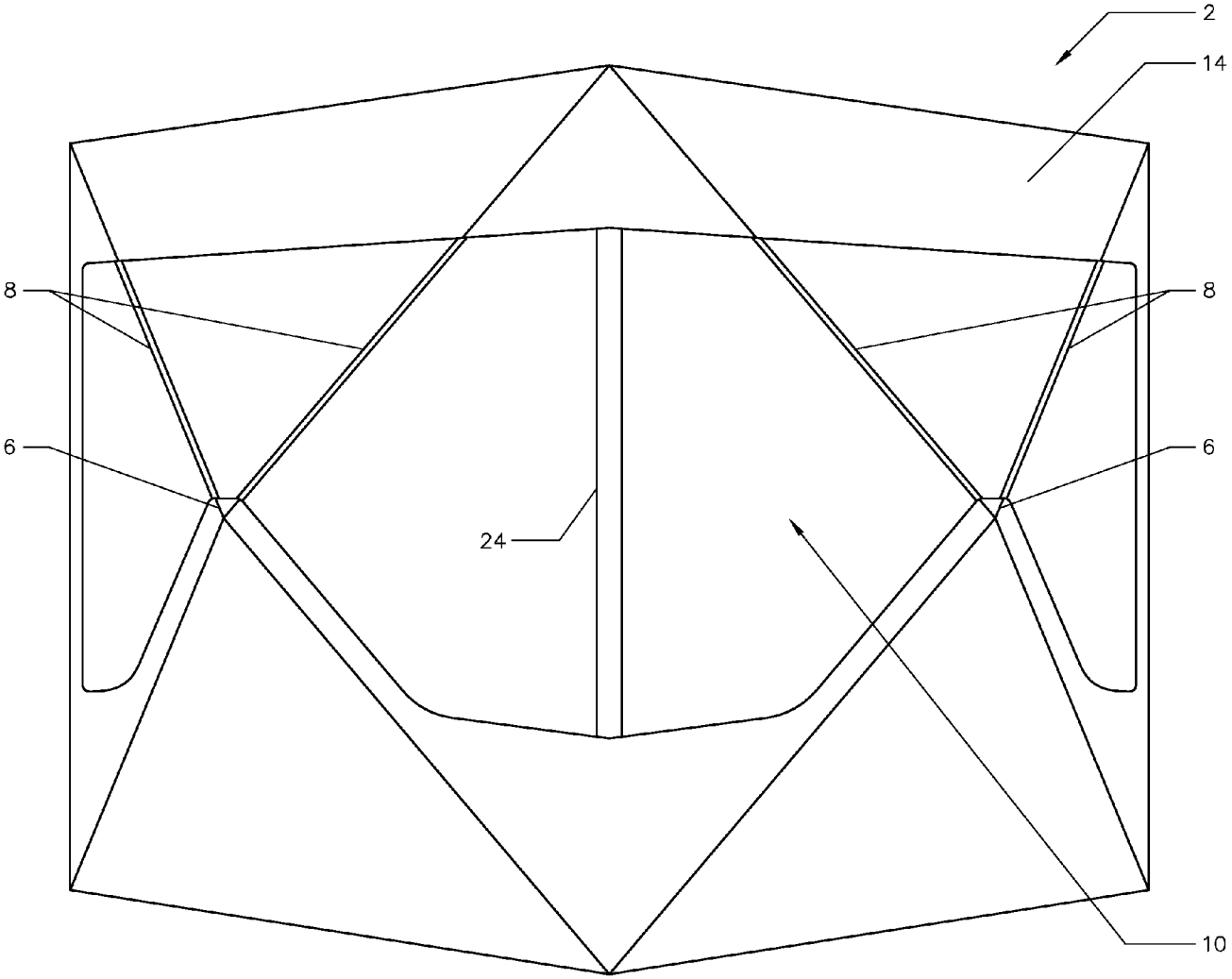
FIG. 1B is a front elevation view of a hunting blind without a top cover and a bottom cover in accordance with embodiments of the invention.

Now referring to FIG. 1B, a front view of a hunting blind 2 that does not have top and bottom covers 12, 14 is provided. The opening 10 in the exterior wall 4 is shown in its entirety. In view of FIG. 1A, it is shown that the covers 12, 14 are configured to change the size and shape of the opening 10 in FIG. 1B.

Figure 2:
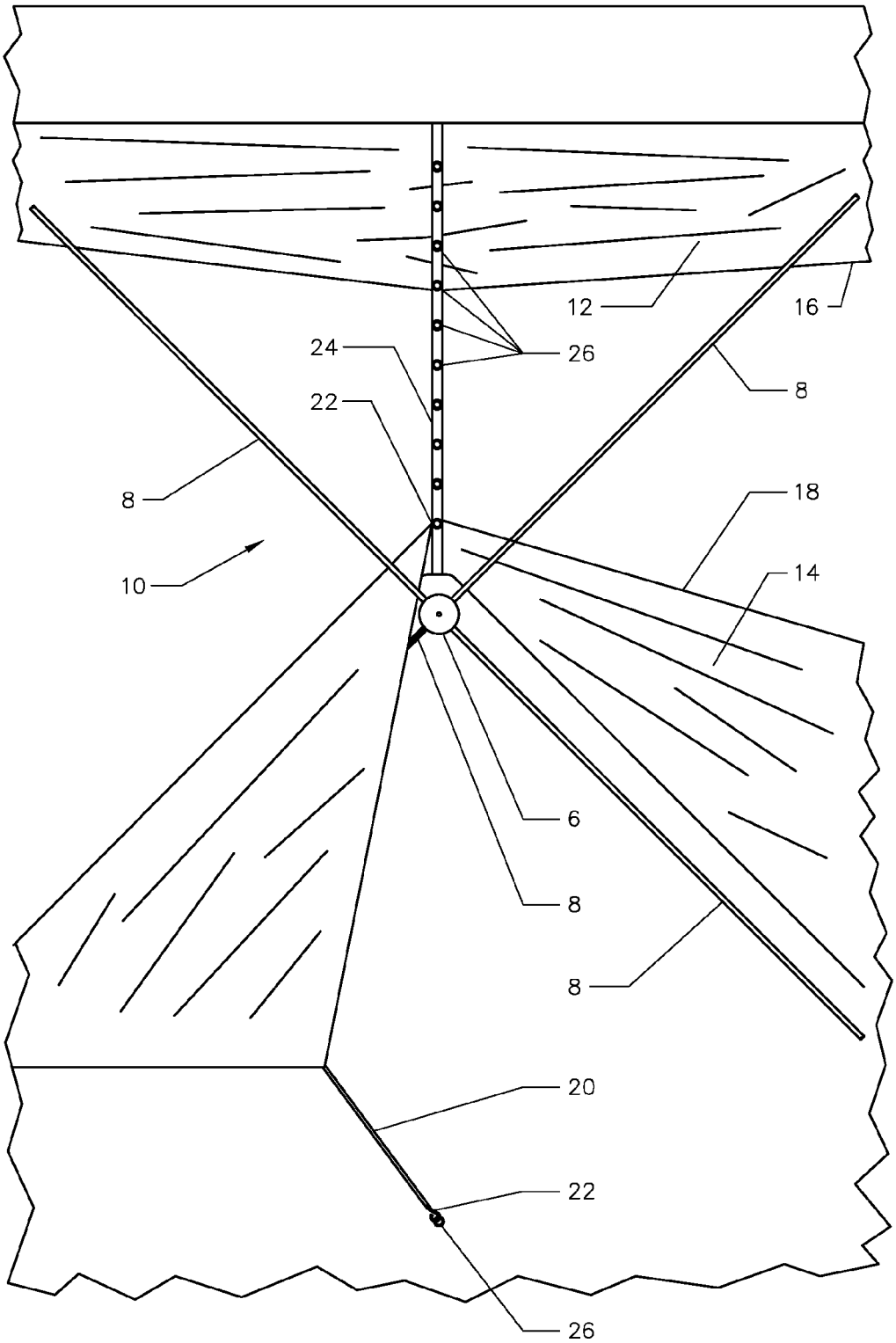
FIG. 2 is an interior view of a top cover and a bottom cover in accordance with embodiments of the invention.

Now referring to FIG. 2, a view of the top and bottom covers 12, 14 from inside the hunting blind 2 is provided. A hub 6 and pole 8 combination is in an opened state and is providing rigidity to a portion of the exterior wall 4 of the hunting blind 2. The exterior wall 4 extends upward to provide a location where the hub 6 may be disposed. The remaining non-exterior wall 4 area is part of the opening 10 of the hunting blind, and the top and bottom covers 12, 14 manipulate the opening 10 into a modified opening.

A cord 20 is disposed along the top edge 18 of the bottom cover 14, and in this embodiment, the cord 20 has elastic properties, which means that the cord 20 returns to an initial length after being stretched or otherwise distorted to a second length. It will be appreciated that in some embodiments, the cord is inelastic but otherwise adjustable to accommodate changes between a plurality of lengths. The edge is stitched or otherwise secured to the bottom cover 14 to provide an interior volume or top edge's passage 18 through which the cord 20 may be disposed. The cord 20 emerges from either end of the top edge's passage 18.

A plurality of first fasteners 22 may be interconnected to the cord 20 at various positions along the cord 20. In the embodiment shown in FIG. 2, a first fastener 22 is interconnected to a first end of the cord 20 and a second end of the cord 20 such that all of the first fasteners 22 are disposed outside of the top edge's passage 18. In addition, one or more first fasteners 22 may be interconnected to an outer surface of the covers 12, 14.

A plurality of second fasteners 26 is disposed on a strap 24 and provides a location for first fasteners 2 to selectively interconnect. The strap 24 is interconnected to the exterior wall 4. In the embodiment in FIG. 2, the strap 24 is oriented vertically and interconnected to the exterior wall 4 above the hub 6 and the exterior wall 4 above the top cover 12. The strap 24 in this embodiment includes plastic buckles at each end such that the strap 24 may be optionally removed from the hunting blind 2. In other words, the strap 24 is removably interconnected to the exterior wall 4, and the strap 24 can have fasteners at either end, including buckles, that interface with complementary features on the exterior wall 4 to provide the removable interconnection. Further, the strap 24 is adjustable in length to accommodate different sized hunting blinds 2.

A first fastener 22 in FIG. 2 is disposed on an outer surface of the bottom cover 14 proximate to the bottom cover's 14 top edge 18 and proximate to a midpoint of the top edge 18. Another view of the first fastener 22 disposed on the cover is provided in FIG. 4A. The first fastener 22 extends upwards and selectively interconnects to one of the second fasteners 26 disposed on the strap 24. This selective interconnection allows the cord 20 and the bottom cover's 14 top edge 18 to be configured in a number of ways to provide a modified opening. In alternative embodiments of the invention, this first fastener 22 may be interconnected to a midpoint of the cord 20, which emerges from the passage to selectively interconnect to one of the second fasteners 26.

A first fastener 22 disposed on one end of the cord 20 is selectively interconnected to a second fastener 26 that is interconnected to the exterior wall 4. This pulls a corner of the lower cover 14 out of the opening 10 of the exterior wall 4 to provide a modified opening. It will be appreciated that second fasteners 26 may be positioned at any location on the exterior wall 4 or any other component of the hunting blind 2. It will be further appreciated that the first fasteners 22 may not be identical to each other. For example, the first fastener 22 at the ends of the cord 20 may be a carabiner-like hook while the first fastener 22 on the outer surface of the bottom cover 14 may be a plastic buckle.

In addition to the description of the strap 24 with respect to FIG. 2, it will be appreciated that embodiments of the present invention may include a strap 24 at other locations on the hunting blind. For example, in FIGS. 1A and 1B, a strap is shown at an edge of the exterior wall of the hunting blind. In yet further embodiments, a hunting blind may have multiple straps, for example, one strap at an edge of the hunting blind and two additional straps, each adjacent to a hub of the hunting blind.

Figure 3:
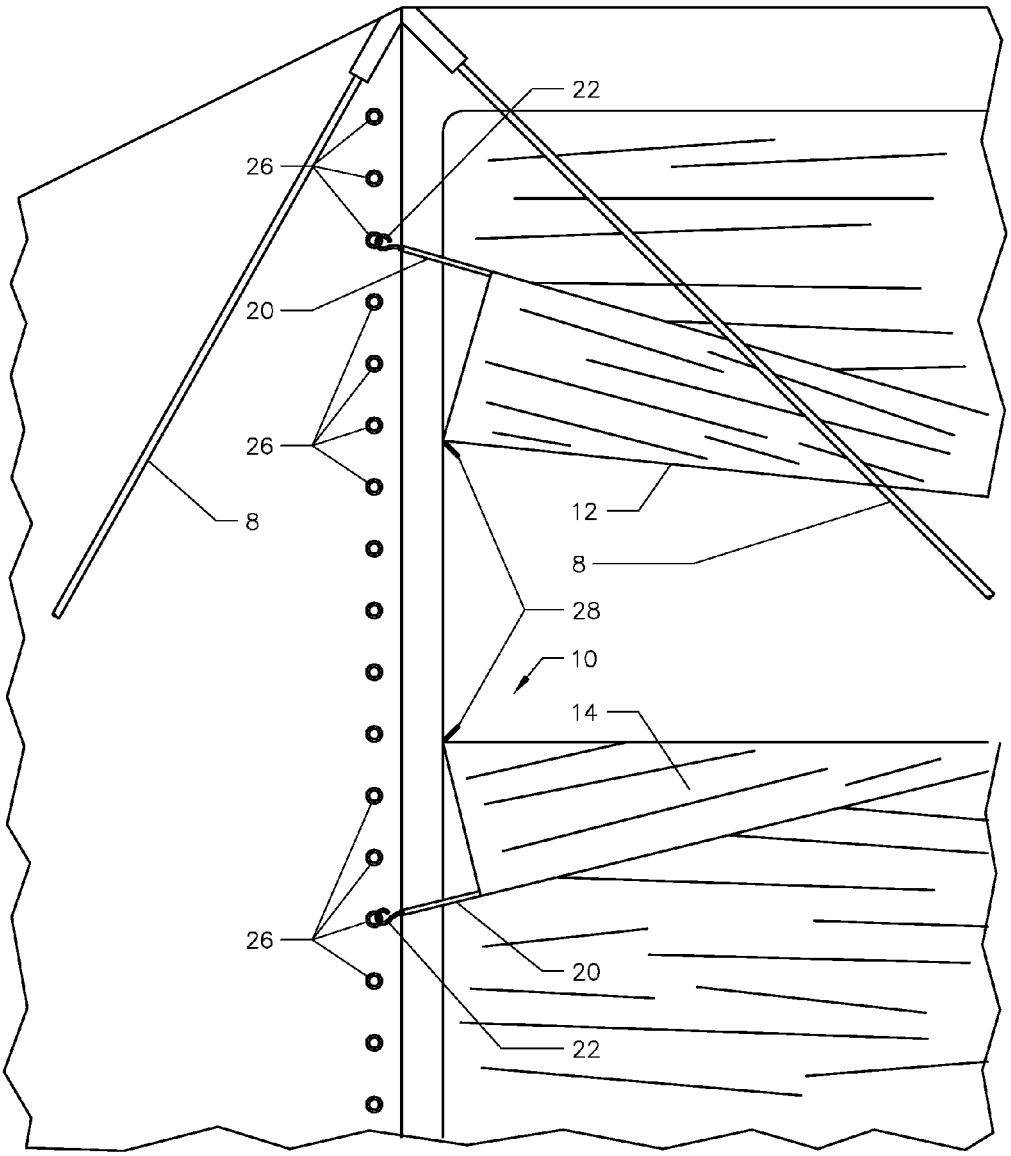
FIG. 3 is an interior view of a top cover and a bottom cover in accordance with embodiments of the invention.

Now referring to FIG. 3, another view of the top and bottom covers 12, 14 from inside the hunting blind 2 is provided. The bottom cover 14 comprises a cord 20, and a first fastener 22 is disposed on an end of the cord 20. The first fastener 22 is selectively interconnected to a second fastener 26 disposed on an inner surface of the exterior wall 4. A plurality of second fasteners 26 is disposed on the inner surface of the exterior wall 4 to provide a number of locations to selectively interconnect with the first fastener 22. Thus, the bottom cover 14 may be configured in a number of ways to provide a modified opening.

Similarly, the top cover 12 also comprises a cord 20 and a first fastener 22 disposed on an end of the cord 20, wherein a plurality of second fasteners 26 provides a range of locations to selectively interconnect with the first fastener 22. It will be appreciated that the top and bottoms covers 12, 14 may not necessarily both have a cord 20 and first fastener 22 combination. For example, in one embodiment the cords 20 for the covers 12, 14 may have a different number of first fasteners 22. In yet further embodiments, the hunting blind 2 may only comprise one of the top cover 12 and the bottom cover 14. Similarly, in some embodiments, the hunting blind 2 may comprise more than two covers 12, 14. The hunting blind 2 may comprise a top cover 12, a bottom cover 14, a left cover, and a right cover where the covers are configurable to provide a modified opening.

Also shown in FIG. 3 is a third fastener 28 disposed along a side edge of the top cover 12, and another third fastener 28 is disposed along a side edge of the bottom cover 14. The third fasteners 28 seal the side edges of the covers, 12, 14 to help protect the internal environment of the hunting blind 2. The third fasteners 28 also help the covers 12, 14 define a modified opening. In the embodiment in FIG. 3, the third fasteners 28. However, it will be appreciated that the third fasteners 28 may be any type of fastener discussed elsewhere herein.

Figure 4A:
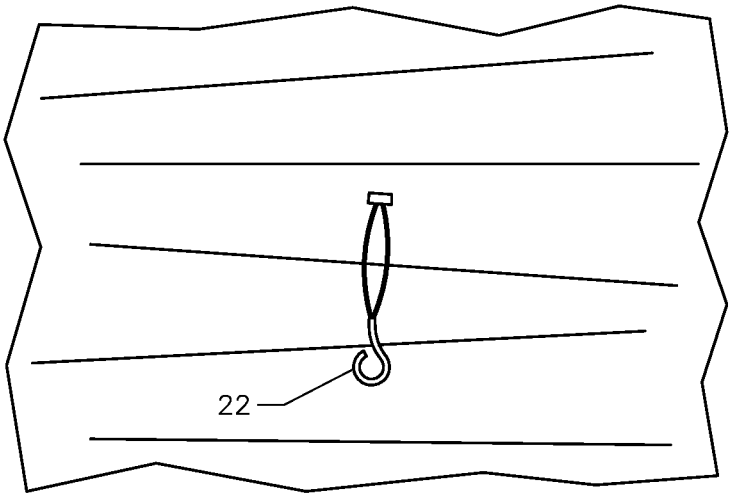
FIGS. 4A and 4B are detailed views of a first fastener and a second fastener in accordance with embodiments of the invention.
Figure 4B:
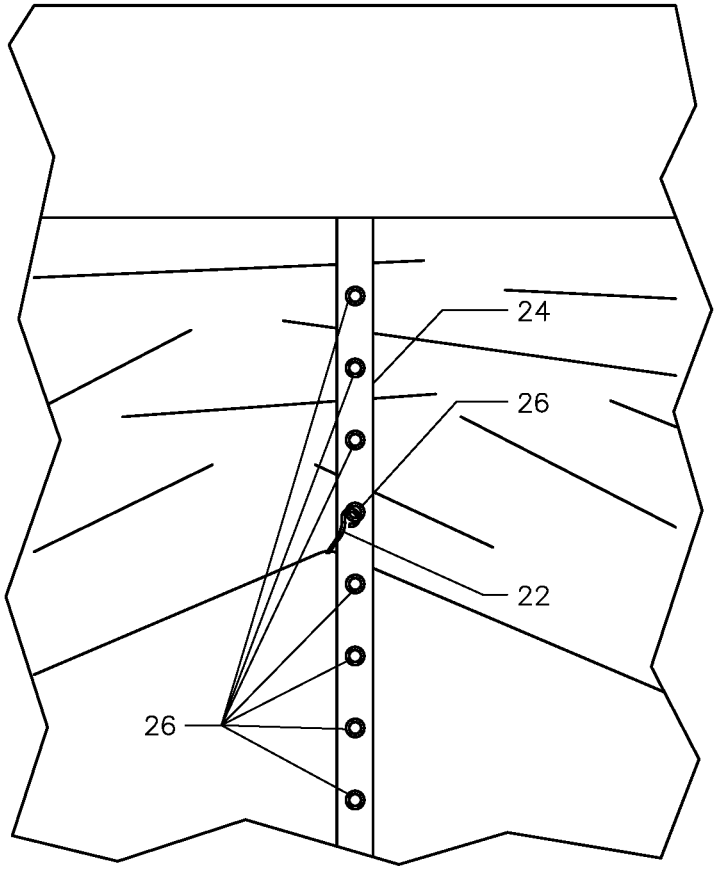

Now referring to FIGS. 4A and 4B, detailed views of a first fastener 22 and a first fastener 22 selectively interconnected to a second fastener 26 are provided, respectively. The first fastener 22 in FIG. 4A has a carabiner-type shape that comprises a nose, basket, and spine. The first fastener 22 may also have an optional gate portion that selectively encloses the central area of the first fastener 22. The first fastener 22 may also have carabiner-like, including an oval shape, a regular D shape, an asymmetrical D shape, and a pear shape.

The second fastener 26 is a ring that is interconnected to the strap 24 via a small portion. To selectively interconnect the first and second fasteners 22, 26, the nose of the first fastener 22 hooks onto the second fastener 26. When the first fastener 22 is pulled taught, the second fastener 26 is positioned on the basket portion of the first fastener 22. The spine of the fastener 22 is the long portion positioned opposite the gap where an optional gate portion may be positioned.

It will be appreciated that the first and second fasteners 22, 26 are not the only fasteners contemplated by embodiments of the invention. For example, a fastener may be a plastic buckle, a snap fastener, Velcro®, a hook-and-loop fastener, a three-ring release system, an bolt, a bayonet mount, a binder clip, a brass fastener, an R-clip, a bungee cord, a cable tie, a circle cotter, a clevis fastener, a lobster clasp, a Terry clip, a zipper, a permanent magnet, an electromagnet, or any other fastener that selectively interconnects two components together.

Figure 5:
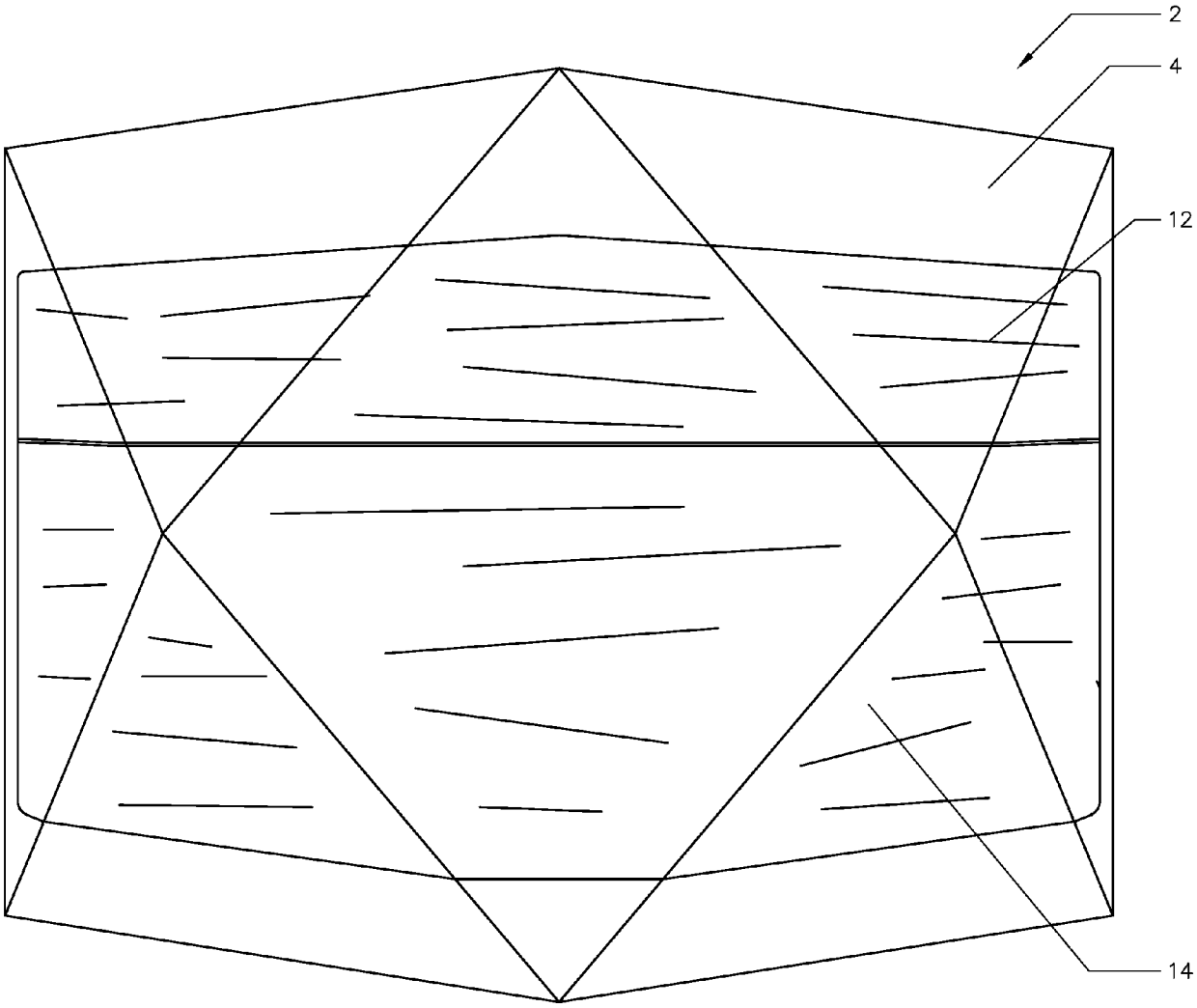
FIG. 5 is a front view of a hunting blind with a top cover and a bottom cover in a closed configuration in accordance with embodiments of the invention.

Now referring to FIGS. 5 to 8, various configurations of the hunting blind's 2 top and bottom covers 12, 14 are provided. The hunting blind's 2 covers 12, 14 in FIG. 5 are in a closed state. This means that the modified opening's area is equal to zero.

Figure 6:
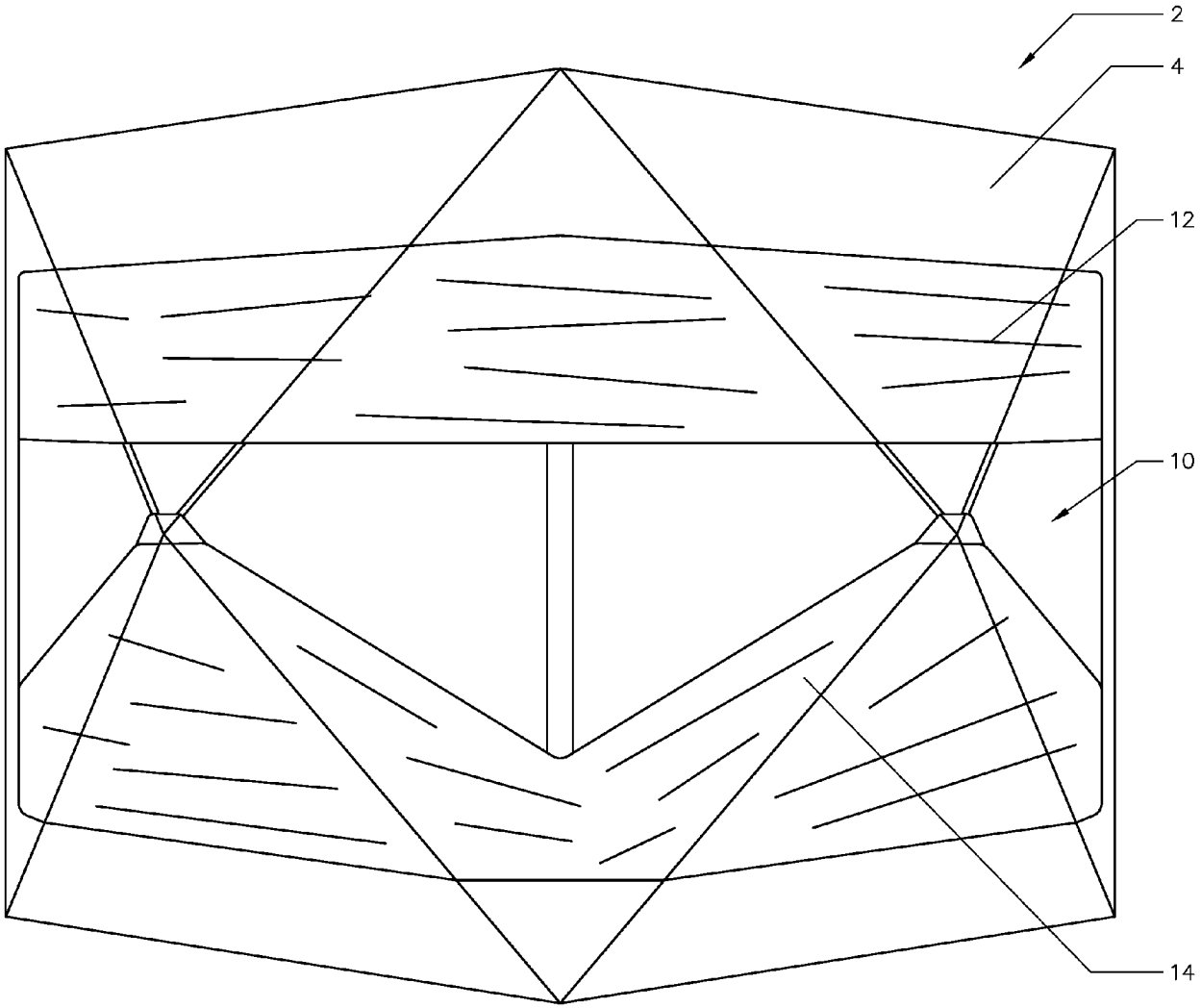
FIG. 6 is a front view of a hunting blind with a top cover and a bottom cover in a first configuration in accordance with embodiments of the invention.

Now referring to FIG. 6, the hunting blind's 2 covers 12, 14 are in a first configuration. The top cover 12 is fully extended downward, and the hunting blind's 2 bottom cover 14 is also in a downward position. This configuration pushes the modified opening lower on the hunting blind 2.

Figure 7:
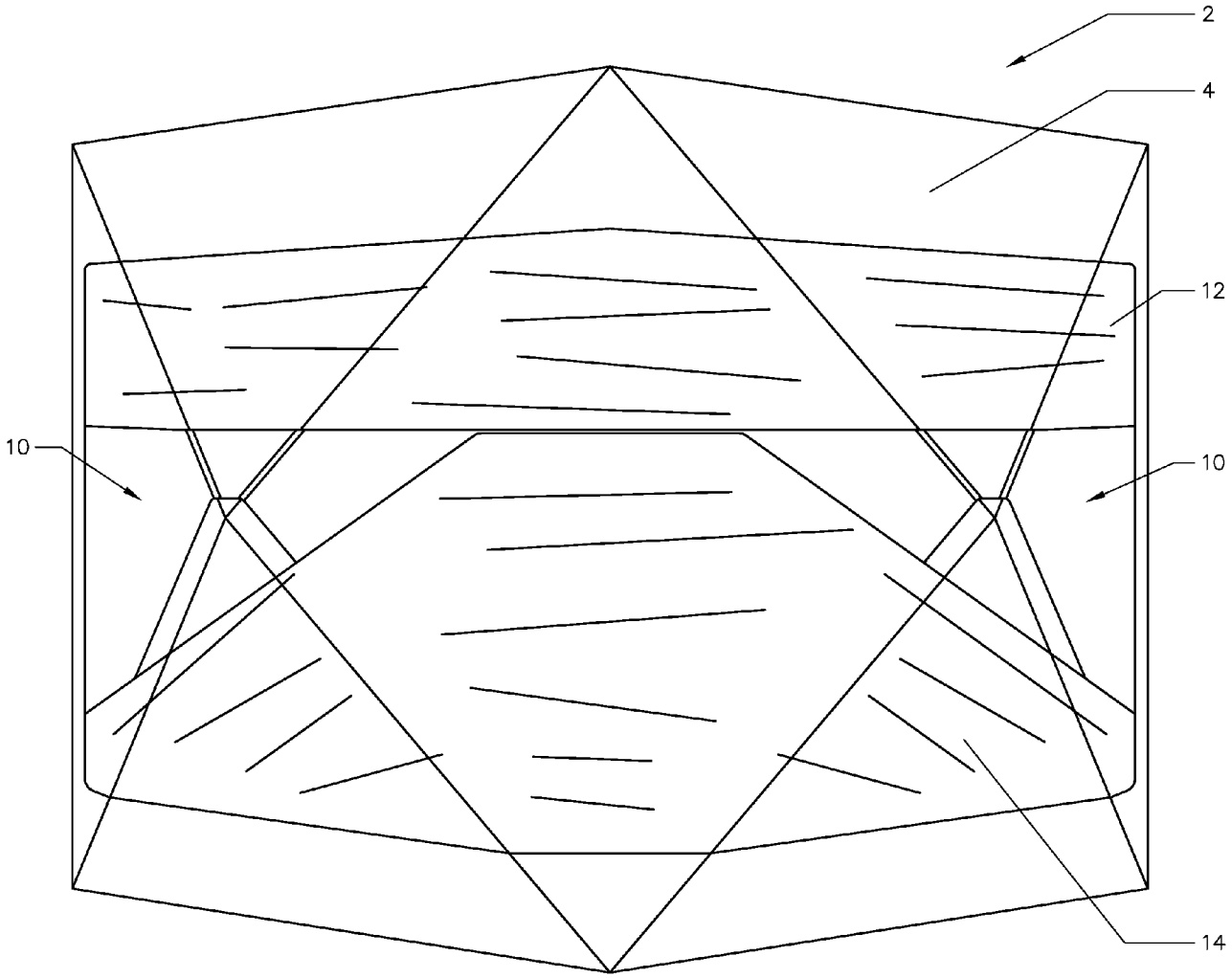
FIG. 7 is a front view of a hunting blind with a top cover and a bottom cover in a second configuration in accordance with embodiments of the invention.

Now referring to FIG. 7, the hunting blind's 2 covers 12, 14 are in a second configuration. The covers 12, 14 meet in the middle of the opening 10, but the covers 12, 14 remain open on each side of the opening 10. The resulting modified opening is actually two separate openings, one disposed on either side of the hunting blind 2.

Figure 8:
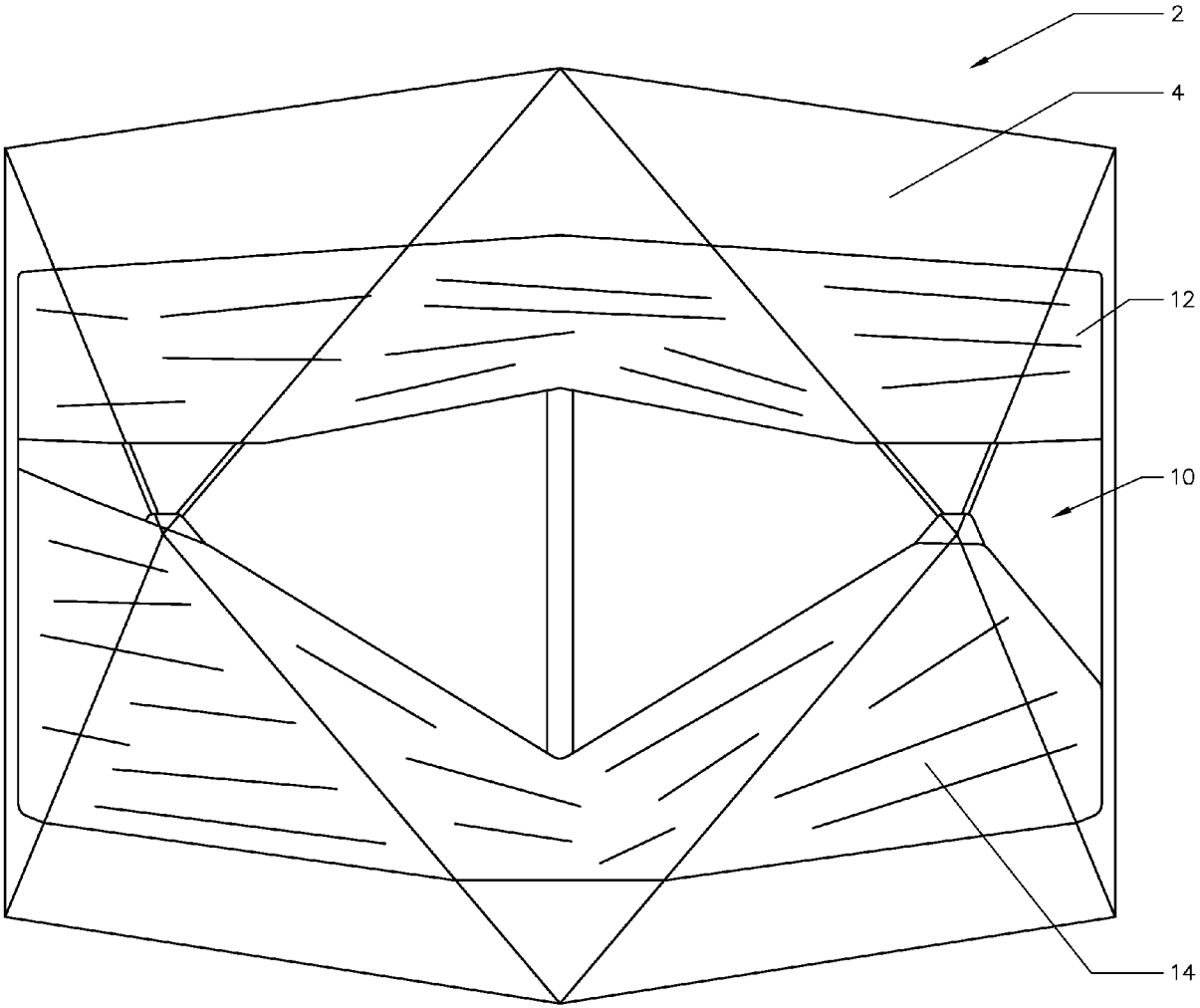
FIG. 8 is a front view of a hunting blind with a top cover and a bottom cover in a third configuration in accordance with embodiments of the invention.

Now referring to FIG. 8, the hunting blind's covers 12, 14 are in a third configuration. The top cover 12 is fully extended downward, and the bottom cover 14 is partially extended upward such that the bottom cover's 14 top edge is not parallel with the ground. Instead, a midpoint of the bottom cover's 14 top edge is positioned lower than the top edge's two ends.

It will be appreciated that the hunting blind's covers 12, 14 may have a variety of additional configurations. For example, in fourth configuration, the top cover 12 is fully extended downward, but the hunting blind's 2 bottom cover 14 is partially extended upward such that the bottom cover's 14 top edge is substantially parallel with the ground. In a fifth configuration, the top cover 12 and the bottom cover 14 meet at the sides of the opening 10, but the midpoint of the top cover's 12 bottom edge extends upward, and the midpoint of the bottom cover's 14 top edge extends downward. This configuration leaves the modified opening positioned in the center of the opening 10.

In a sixth configuration, the midpoint of the top cover's 12 bottom edge extends downward while the ends of the bottom edge remain upward. The midpoint of the bottom cover's 14 top edge extends downward while the ends of the top edge extend upward. In a seventh configuration, the midpoint of the top cover's 12 bottom edge extends upward while the ends of the bottom edge extend downward. The midpoint of the bottom cover's 14 top edge extends upward while the ends of the top edge extend downward.

Figure 9:
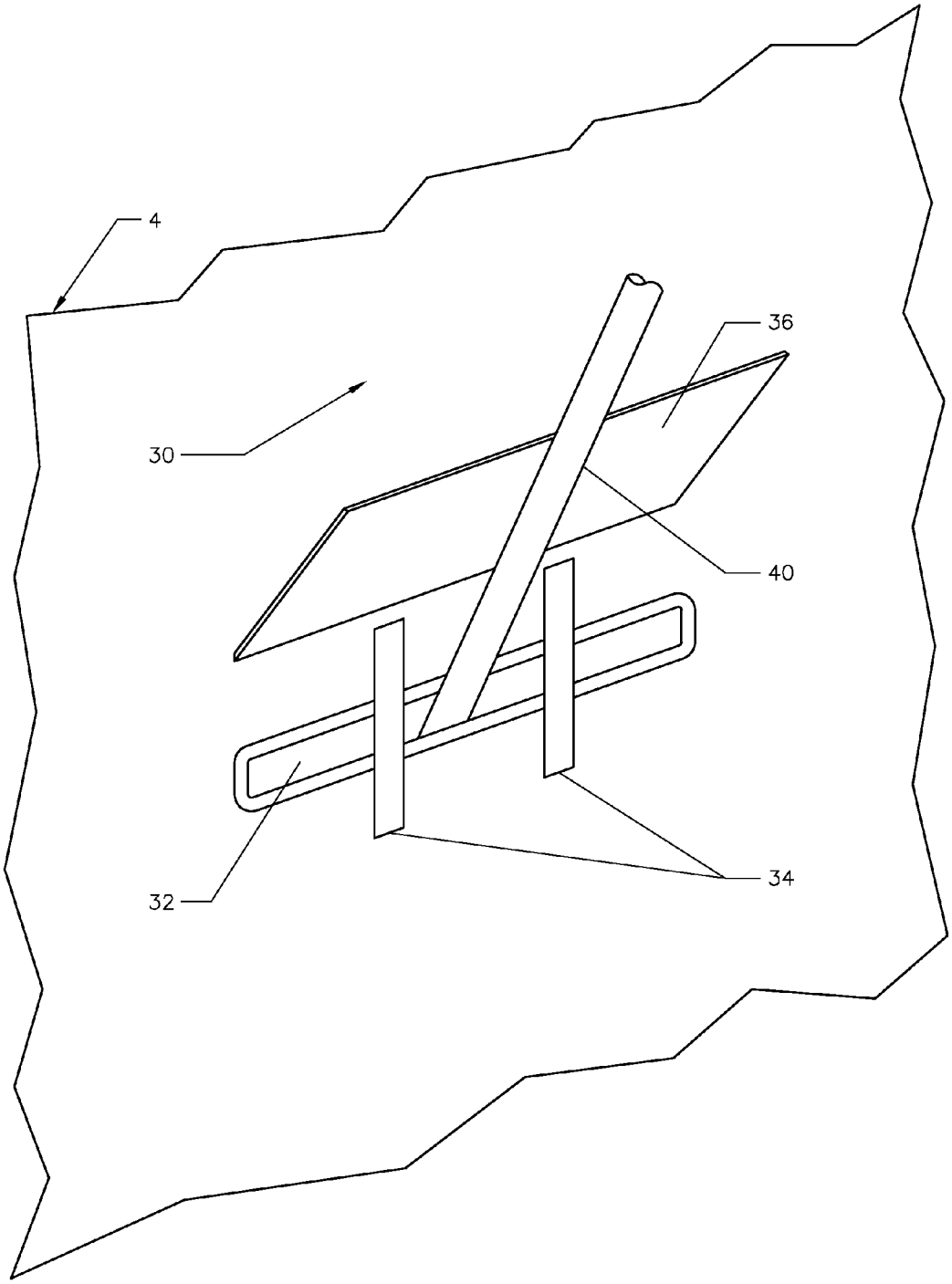
FIG. 9 is an interior view of a hunting blind with a pass-through feature and a tripod in accordance with embodiments of the invention.

Now referring to FIG. 9, a pass-through feature 30 is provided. The pass-through feature 30 comprises an opening 32 in the exterior wall 4 of the hunting blind that allows objects, such as a tripod, to pass through the exterior wall 4. In the specific case of the tripod, the pass-through feature 30 allows the tripod and any instruments disposed on the tripod to be closer to the exterior wall 4. This helps increase the available space within the hunting blind because the entirety of the tripod does not need to be disposed in the hunting blind.

The opening 32 in FIG. 9 is a lateral slot that is oriented substantially parallel with the ground. It will be appreciated that the pass-through opening 32 may come in a variety of configurations and orientations. For example, the opening 32 may be oriented vertically with one end positioned proximate to the ground. In addition, the opening 32 may be disposed on any component of the hunting blind, including the covers discussed elsewhere herein.

Two straps 34 are positioned across the opening 32 to maintain the integrity of the exterior wall 4. These straps 34 are interconnected to the exterior wall 2 on either side of the opening 32. In some embodiments, the pass-through feature 30 may comprise zero, one, or three or more straps 34. Further, the straps 34 may be selectively interconnected to the exterior wall 4 using any type of fastener discussed elsewhere herein.

A sealing flap 36 is positioned proximate to the opening 32 of the pass-through feature 32. The flap 36 is oriented substantially parallel to the ground with one side of the flap 36 interconnected to the exterior wall 4. The flap 36 may rotate about this interconnection to cover the opening 32.

Fasteners disposed on the flap 36 and the exterior wall 4 allow the flap 36 to selectively interconnect to the exterior wall 4. This allows the flap 36 to cover the opening 32 when the pass-through feature 30 is not in use to protect the interior of the hunting blind against the environmental elements. It will be appreciated that the fasteners disposed on the flap 36 and the exterior wall 4 may be any fasteners described elsewhere herein.

Also shown in FIG. 9 is a tripod 40 in the hunting blind is positioned close to the pass-through feature 30, and one of the tripod's 40 legs physically passes through the pass-through feature 32, which allows the tripod 40 set closer to the exterior wall 4 and preserve space within the hunting blind. While this exemplary figure shows a tripod 40, the pass-through feature 30 has many other applications. For example, the pass-through feature 30 may be used to vent air from the hunting blind, to provide a line of sight out of the hunting blind, to dispose instruments for monitoring environmental conditions, to place scents, etc.

The pass-through feature 30 may also comprise a sleeve that conceals the tripod's 40 leg. Tripods 40 and other devices are often made from metallic or other reflective materials. Thus, it is desirable to maintain the camouflage function of the hunting blind 2, even when a pass-through feature 30 is used. The sleeve may interconnect or selectively interconnect to at least a portion of the opening 32, and the sleeve may encapsulate the tripod 40 leg as the leg extends through the pass-through feature 30. Therefore, when the tripod 40 leg is fully extended through the pass-through feature 30, the sleeve camouflages the leg and maintains the overall camouflage function of the hunting blind 2.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A portable blind with an adjustable opening, comprising:

an exterior wall defining an interior volume;

an opening in said exterior wall, said opening having a first area;

a top cover partially closing said opening, said top cover having a bottom edge, wherein said bottom edge at least partially defines a passage extending along said top cover;

a bottom cover partially closing said opening, said bottom cover having a top edge, wherein said top edge at least partially defines a passage extending along said bottom cover;

a vertically oriented strap positioned at an edge of said exterior wall, said strap having a first end and a second end, said first end removably interconnected to an upper portion of said exterior wall and said second end removably interconnected to a lower portion of said exterior wall such that said strap extends across said opening, said strap having a plurality of first fasteners;

a first cord disposed in said passage of said top cover, wherein at least one second fastener on said first cord is selectively interconnected to said plurality of first fasteners on said strap to control a position of said bottom edge of said top cover over said opening; and a second cord disposed in said passage of said bottom cover, wherein at least one second fastener on said second cord is selectively interconnected to said plurality of first fasteners on said strap to control a position of said top edge of said bottom cover over said opening, wherein said top cover and said bottom cover at least partially define a modified opening having a second area, wherein said first area is larger than said second area.

2. The portable blind of claim 1, wherein said top cover has a first shape in a relaxed state, and said top cover has a second shape in a tensioned state when said first cord is selectively interconnected to said strap, wherein said first shape is distinct from said second shape.

3. The portable blind of claim 1, further comprising:

a second strap positioned adjacent a hub of said hunting blind, said hub interconnected to a frame that supports said exterior wall, wherein said second strap has a first end and a second end, said first end removably interconnected to said upper portion of said exterior wall, and said second end removably interconnected to said lower portion of said exterior wall, wherein said first and second cords are selectively interconnected to said second strap.

4. The portable blind of claim 1, further comprising:

a second fastener disposed at one end of said first cord and another second fastener disposed at the other end of said first cord; and a plurality of first fasteners disposed on an inner surface of said exterior wall, wherein said second fasteners disposed on said ends of said first cord are selectively interconnected to said plurality of first fasteners.

5. The portable blind of claim 1, wherein said bottom cover has a first shape in a relaxed state, and said bottom cover has a second shape in a tensioned state, wherein said first shape is distinct from said second shape.

6. The portable blind of claim 1, further comprising:

a pass-through feature disposed on said exterior wall, said pass-through feature comprising a pass-through opening, a flap positioned proximate to said pass-through opening on an inner surface of said exterior wall, and a rigidity element disposed across said pass-through opening, wherein said flap selectively covers at least a portion of said pass-through opening.

7. The portable blind of claim 1, wherein a second fastener of said first cord is selectively interconnected to a first fastener of said strap, wherein said second fastener has a central area, and said first fastener is a ring, wherein said second fastener hooks onto said first fastener and said ring is positioned in said central area to provide said selective interconnection.

8. The portable blind of claim 1, further comprising:

a second fastener disposed at one end of said second cord and another second fastener disposed at the other end of said second cord; and a plurality of first fasteners disposed on an inner surface of said exterior wall, wherein said second fasteners disposed on said ends of said second cord are selectively interconnected to said plurality of first fasteners.

* * * * *